US006585552B2

(12) United States Patent
Huset

(10) Patent No.: US 6,585,552 B2
(45) Date of Patent: Jul. 1, 2003

(54) CIRCULAR FLYING DISC TOY

(76) Inventor: Lawrence A. Huset, 2208 State Ave., Apt. B, Costa Mesa, CA (US) 92627

( * ) Notice: Subject to any disclaimer, the term of this patent is extended or adjusted under 35 U.S.C. 154(b) by 0 days.

(21) Appl. No.: 09/932,854

(22) Filed: Aug. 17, 2001

(65) Prior Publication Data

US 2002/0081935 A1 Jun. 27, 2002

Related U.S. Application Data

(63) Continuation-in-part of application No. 09/476,259, filed on Jan. 3, 2000.

(51) Int. Cl.[7] ..... A63H 27/00

(52) U.S. Cl. ..... 446/46; 446/253

(58) Field of Search ..... 446/253, 46, 47, 446/48

(56) References Cited

U.S. PATENT DOCUMENTS

| | | | | |
|---|---|---|---|---|
| 29,055 A | | 7/1860 | Brown | |
| 3,158,404 A | | 11/1964 | Noakes | |
| 3,566,532 A | | 3/1971 | Wilson | |
| 3,784,204 A | | 1/1974 | Felber | |
| 4,112,612 A | | 9/1978 | Woods | |
| 4,253,269 A | | 3/1981 | Sullivan | |
| 4,356,660 A | | 11/1982 | O'Brien | |
| 4,940,441 A | | 7/1990 | Novinsky | |
| 4,986,790 A | | 1/1991 | Boury | |
| 5,127,390 A | | 7/1992 | Paulson | |
| 5,512,028 A | * | 4/1996 | Sparks, III | 446/253 |
| 5,816,965 A | | 10/1998 | Kotler | |
| 6,113,453 A | | 9/2000 | Stuffelbeam | |

* cited by examiner

*Primary Examiner*—Derris H. Banks
*Assistant Examiner*—Urszula Cegielnik

(57) ABSTRACT

A flying disc toy includes a cylindrical rim and a flat circular airfoil located within the rim. The centerline of the edge of the airfoil is positioned to bisect the side surface of the rim, resulting in a flying disc toy of increased stability and throwing ease. A cord, preferably of elastic material, is tethered to the symmetrical center of the circular airfoil.

19 Claims, 5 Drawing Sheets

CIRCULAR FLYING DISC TOY

CROSS REFERENCE TO RELATED APPLICATION

This application is a continuation-in-part of application Ser. No. 09/476,259, filed on Jan. 3, 2000 for Circular Flying Dick Toy, the disclosure thereof being incorporated herein by reference.

BACKGROUND OF THE INVENTION

1. Field of the Invention

The subject invention relates generally to toys and amusement devices and more particularly to an aerodynamic disc consisting of a circular center airfoil centered within a circular outer rim or ring.

2. Description of Related Art

Flying saucer devices, or so-called "frisbees," are known in the prior art. Such devices have been used as throwing implements or toys, typically in games of "catch." Such devices typically employ a central disc portion and a rim extending downwardly from and circumscribing the central disc, for example, as disclosed in U.S. Pat. No. 3,359,678.

SUMMARY OF THE INVENTION

The present invention provides a flying disc toy including a cylindrical rim having a circular top edge running parallel to a circular bottom edge. A flat circular central airfoil having a circular edge is attached to the inner circumference of the rim such that the vertical height of the cylindrical rim extends beyond the circular edge in opposite directions by equal amounts. In addition, the central airfoil has a small aperture at its symmetrical center through which a cord of elastic or inelastic material is passed and tethered to the airfoil by a knot, either through a spherical bead or knot. When thrown, the flying disc provides increased gyroscopic effect and stability. The cord tethered to the disc may be used for catching, throwing, holding, or moving the disc about while it is spinning.

BRIEF DESCRIPTION OF THE DRAWINGS

The just summarized invention will now be described in detail in conjunction with the drawings of which.

DETAILED DESCRIPTION

Figure 1:
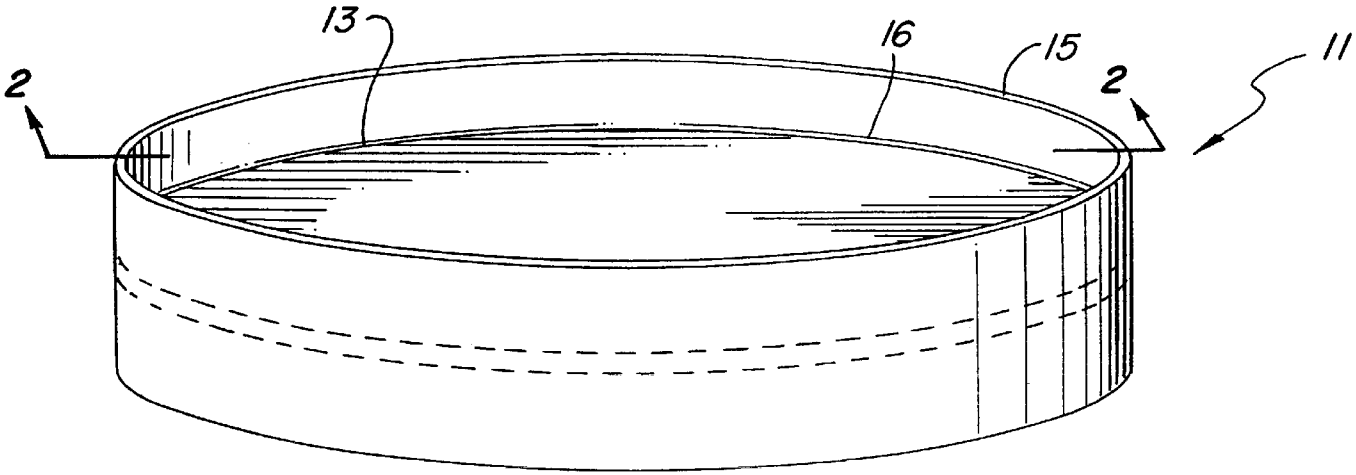
FIG. 1 is a perspective view of a first embodiment of the invention.
Figure 2:
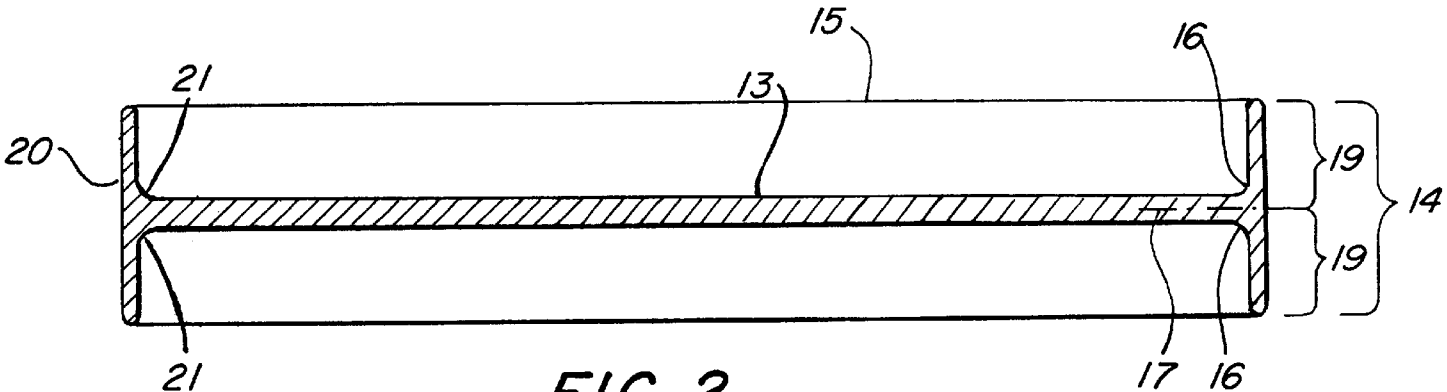
FIG. 2 is a sectional view taken at 2—2 of FIG. 1.

A flying disc toy 11 according to a preferred embodiment is shown in FIGS. 1 and 2. The center circular portion or airfoil 13 of this disc toy 11 is planar, constructed of a plastic foam board, or any other equivalent light-weight material and can vary in diameter, e.g., between 5 inches to 12 inches. The outer rim 15 is cylindrical, comprised of the same material as the airfoil 13, and may vary in height from 1 inch to 2 inches in correlation to the size of the center circular portion or airfoil 13.

The outer rim 15 is positioned around the airfoil 13 and attached at a 90 degree angle with a glue gun or other adhesive. In the alternative, the outer rim and airfoil are molded as one piece. The outer rim 15 is attached to the airfoil 13 such that the center line 17 of the edge of the airfoil 13 bisects the side surface 20 so that equal portions 19 of the side surface 20 extend to each side of center line 17. For a 10 inch diameter disc, for example, the side portions 19 may each be about ¾ inch. As a result, the top and bottom of the flying disc toy 11 are mirror images of one another.

After the outer rim 15 is attached to the airfoil 13, silicone is applied over the perimeter of seams 21, or "equatorial line," where the outer rim 15 connects to the airfoil 13. The Silicone is smoothed evenly around the entire circumference on both sides to that both sides, have a smoothed layer of silicone 16 where the airfoil 13 and outer rim 15 connect. This treatment increases the circumferential weight at the outer rim 15, increasing the gyroscopic effect tending to level the disc in flight.

The height of the rim 15 in relation to the diameter of the airfoil 13 determines distance performance. Thus, for example, with an airfoil diameter of 8 inches, use of a vertical rim height 14 of 1½ inches results in substantially more air resistance than a vertical rim height of 1¼ inches. A ratio of diameter versus height of rim could vary from a ratio of 5:1 to a ratio of 8:1 without significantly effecting performance. Only the distance of flight is affected by this ratio. Greater height of the outer vertical rim results in more air caught between the airfoil and the outer rim, thus resulting in a more pronounced floating effect. A ratio of diameter to rim height greater than 9 to 1 has been found to result in instability of flight causing the flying disc to veer to the right or left.

Figure 3:
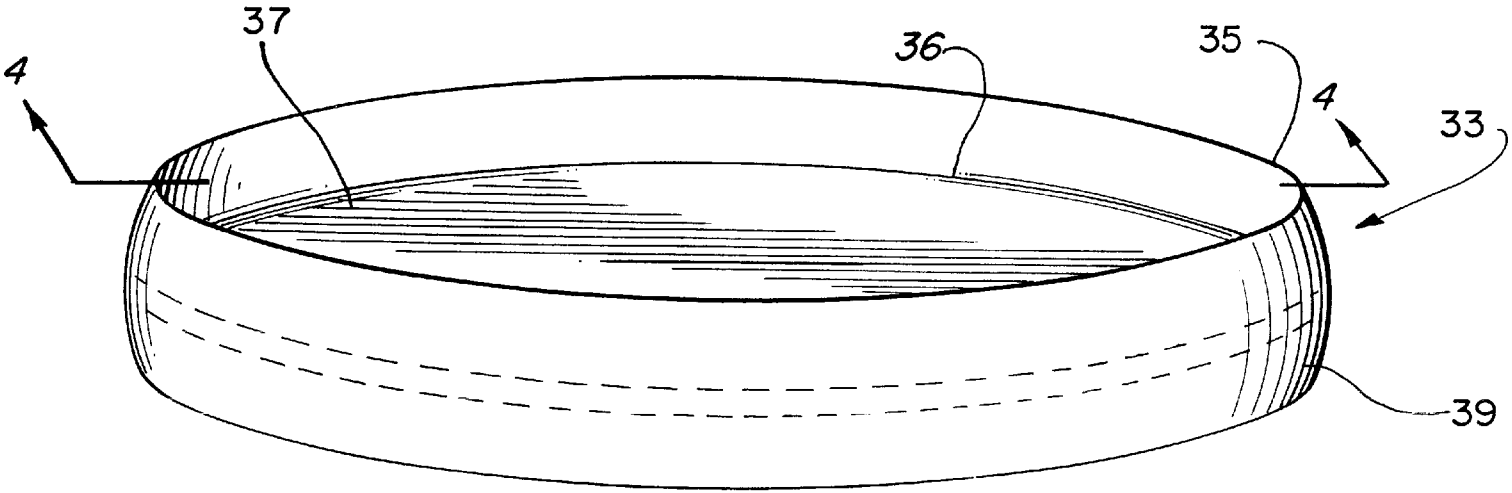
FIG. 3 is a perspective view of a second embodiment.
Figure 4:
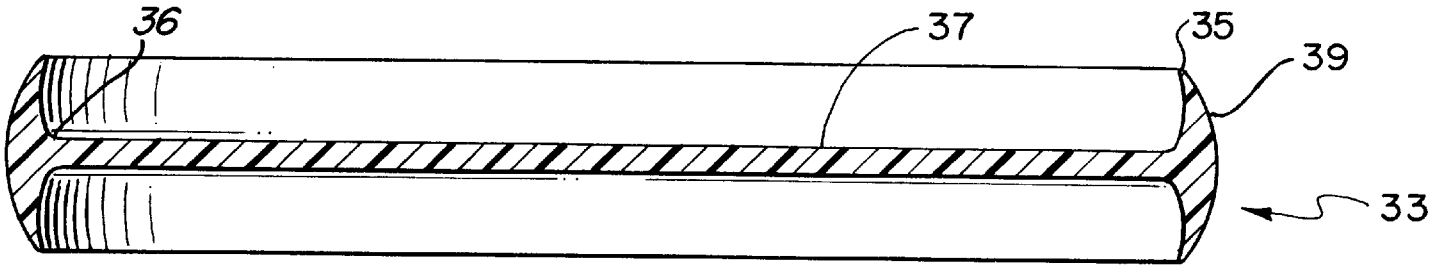
FIG. 4 is a sectional view taken at 3—3 of FIG. 3.

For production purposes, it is presently preferred to fabricate a flying disc 33 (FIGS. 3 and 4) by a plastic injection molding process. The result is a molded plastic body including a flat circular airfoil 37 bounded about its perimeter by a rim portion 35 extending an equal distance on each side of the airfoil 37. The rim portion 35 is at a 90 degree angle to the airfoil 37 for the entire circumference of the airfoil. The circumferential weight 36 in the form of extra material at the outer ring 35, where the center airfoil 37 connects to the outer rim 35 is added as needed during the injection molding pricess. The outer surface 39 of the rim portion 35 may curve upwardly and downwardly from the center airfoil 37 enabling manual projection from either of the two identical sides.

The flying disc 33 is thus shaped to provide a body having an aerodynamic profile, such that when it is flung through the air with a spinning motion, it appears to sail, or "float," through the air. The spinning motion imparted by a wrist-flick gyroscopically stabilizes the flight.

Flying discs such as those shown in FIGS. 1–4 may be thrown by the user in a backhanded motion with one hand, keeping the arm parallel with the ground, and ending the throw with a snapping motion of the wrist. Variations of the angle of the arm at launch determine the angle of flight relative to altitude and direction.

The flying discs 11, 33 are easier to throw and catch due to their shape, levelness, and the effect of "floating" toward the receiving individual, rather than being "whipped" toward that individual. Children adapt to the flying toy more quickly and easily, due to the steadiness of the flight and the ability to toss the flying disc along a more level path and at a shorter range. This flying disc can also be thrown in areas that previously did not lend themselves to this activity because the discs can be comfortably thrown at a closer range than those of the prior art, which is especially important in densely populated areas. Thus, a large playing field is unnecessary, and the flying disc of this invention can be comfortably used in an average-sized yard. It is also impossible for the flying disc to be upside-down when thrown since both the top and bottom are identical.

Figure 5:
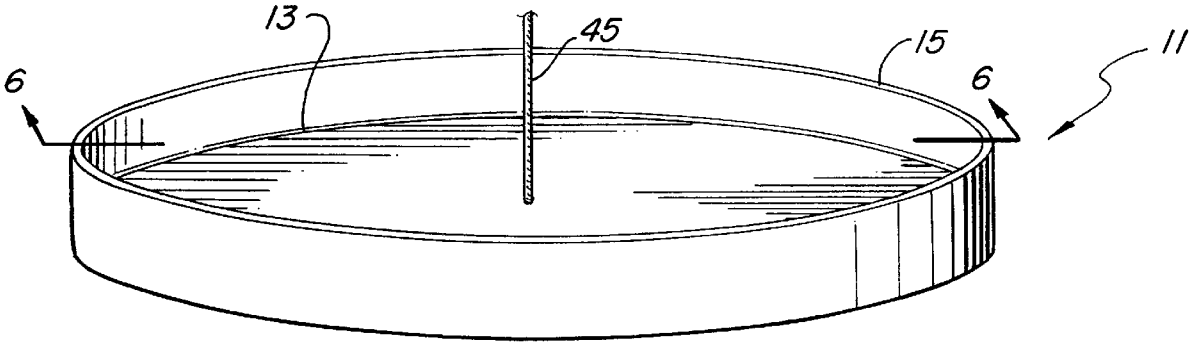
FIG. 5 is a perspective view of another embodiment of the invention.
Figure 6:
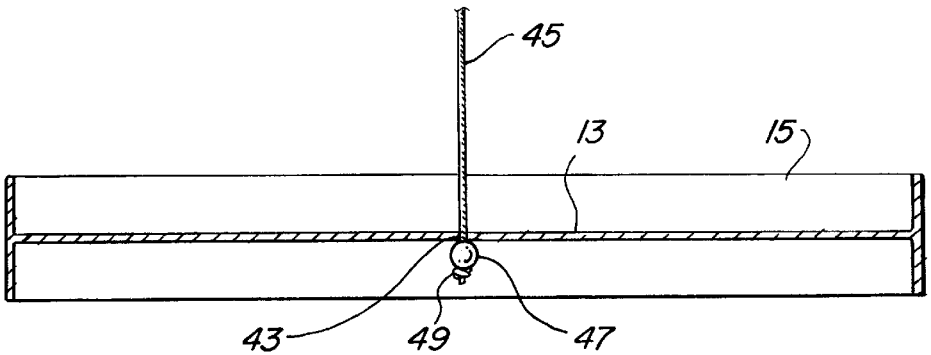
FIG. 6 is a sectional view taken along line 6—6 of FIG. 5.

Enjoyment of the flying disc toy 11 can be enhanced by adding a cord 45 (FIG. 5) that is attached to the symmetrical center of the airfoil 13. The cord 45 may be an elastic bungie-type cord or a non-elastic strap or strip of plastic or string strong enough to withstand the forces exerted on it during play. The cord 45 is preferably 1/16 inch to 1/4 inch wide and 12 to 60 inches long.

The cord 45 is attached to the airfoil 13 by any one of a number of ways. An aperture 43 may be placed in the airfoil at its symmetrical center. The aperture should be no larger than an 1/8 inch in diameter. A spherical bead of glass, steel, or plastic, or equivalent material, with a hole through its center is threaded onto the cord 45 and placed at one end 49 where it is held by a knot 48, bulge, or equivalent. The other end of the cord 45 is threaded through the aperture 43 in the airfoil 13. The bottom side of airfoil 13 then rests on the bead 47. When the flying disc toy is spinning, it rotates around the cord 61 on the bead 63, with the bead 63 acting as a relatively frictionless bearing.

Figure 7:
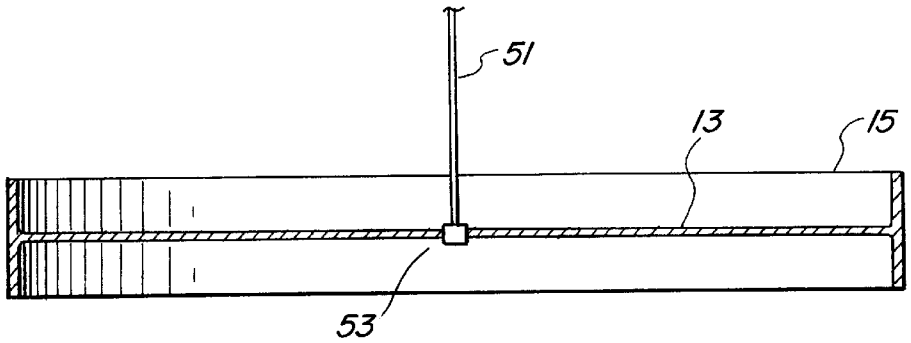
FIG. 7 is a sectional view taken along line 6—6 of FIG. 5 showing an alternative attachment method for the cord.

The cord 45 may alternatively be attached to the airfoil 13 by a swivel attachment 53 (FIG. 7) that is placed at the symmetrical center of the airfoil 13.

The flying disc toy 33 with a curved outer surface 39 on its outer rim 35, also has an aperture 59 in the airfoil 37 at its symmetrical center. A spherical bead 47 held between a stop 49 and the bottom of the airfoil 37 acts as a bearing surface for the rotation of the disc 33 about its cord 45.

In use, the cord 45 is held by one hand which the other hand is used to start the disc spinning. The disc will continue to spin on its axis maintaining its orientation with the play surface while it is propelled back and fourth, up and down and around, by manipulation of the cord 45. When the cord 45 is attached to a long pole, the flying disc can be manipulated high in the air with hovering and darting movements that resemble a flying saucer. In this manner, the flying disc toy can be used and enjoyed by a single individual. The flying disc toy with elastic cord can thus be used as a hybrid, gyroscope spinning yo-yo.

When multiple users are involved in multiple-user play, the disc may be caught by its cord. When so caught, the disc continues to spin and glide from the force of the spinning thrust until its inertia is negated by the capture of the elastic cord. When captured, its path comes to a mild stop and begins to move in the opposite direction, as it continues to spin.

Figure 8:
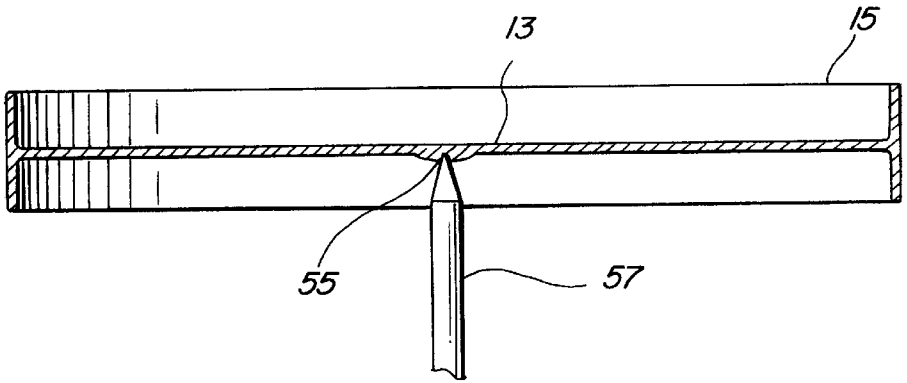
FIG. 8 is a sectional view of an alternate embodiment of FIG. 1.
Figure 9:
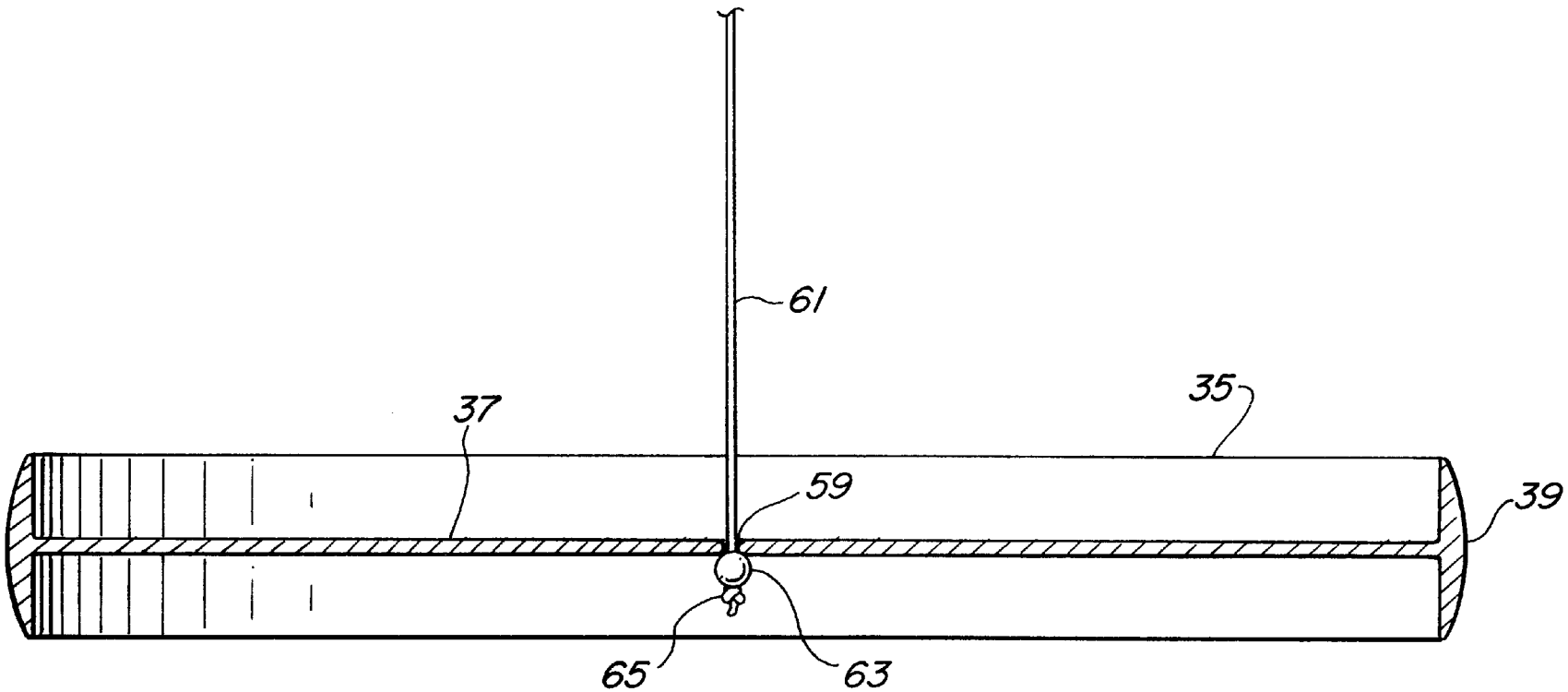
FIG. 9 is a sectional view of the embodiment of FIG. 3 with a cord tether.

In an alternate embodiment shown in FIG. 8, a flying disc toy is shown wherein the airfoil 13 has an indentation at its symmetrical center to permit the disc to rotate and spin on a pointed object 57, like a pen or pencil, for example.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A flying toy comprising:

a circular center airfoil having a fixed diameter, an outer edge, a top surface, and a bottom surface, the top surface being planar, the bottom surface being planar and spaced apart from the top surface;

a cylindrical outer rim having a diameter equal to the diameter of the circular center airfoil fastened to the circular center airfoil at the outer edge of the circular center airfoil, the cylindrical rim having a vertical height that extends beyond the top surface and bottom surface of the circular center airfoil;

a cord attached to the circular center airfoil; and weighting means for increasing the weight of the toy at the intersection of said circular center airfoil and said outer cylindrical rim.

2. The flying toy of claim 1 wherein said outer cylindrical rim has a curved outer side surface.

3. The flying toy of claim 1 wherein said toy is formed as a single part.

4. The flying toy of claim 1 wherein said circular center airfoil is a solid member.

5. The flying toy of claim 1 wherein the diameter of the circular center airfoil is within the range of five inches to twelve inches, inclusive.

6. The flying toy of claim 1 wherein the vertical height of the cylindrical outer rim is within the range of one inch to two inches, inclusive.

7. The flying toy of claim 1 wherein the ratio of the circular center airfoil diameter to vertical height of the cylindrical outer rim is within the range of 5:1 to 9:1.

8. The flying toy of claim 1 wherein said cord is attached to the symmetrical center of the circular center airfoil.

9. The flying toy of claim 1 wherein said cord is an elastic cord attached to the symmetrical center of the circular center airfoil.

10. The flying toy of claim 1 wherein the circular center airfoil includes an aperture through its symmetrical center; and said cord is attached to the circular center airfoil by passing through the aperture in the circular center airfoil.

11. The flying toy of claim 10 further comprising a knot at one end of the cord resting against one surface of the circular center airfoil.

12. The flying toy of claim 11 further comprising a bead with an aperture therethrough, the cord passing through the aperture in the bead and the aperture in the circular center airfoil, whereby the bead provides a bearing surface for rotation of the airfoil about the cord.

13. The flying toy of claim 3 wherein said cord is attached to the symmetrical center of the circular center airfoil.

14. The flying toy of claim 3 wherein said coil is an elastic cord attached to the symmetrical center of the circular center airfoil.

15. The flying toy of claim 3 wherein the circular center airfoil includes an aperture through its symmetrical center; and said cord is attached to the circular center airfoil by passing through the aperture in the airfoil.

16. The flying toy of claim 15 further comprising a knot at one end of the cord resting against one surface of the circular center airfoil.

17. The flying toy of claim 16 further comprising a bead with an aperture therethrough, the cord passing through the aperture in the bead and the aperture in the circular center airfoil, whereby the bead provides a bearing surface for rotation of the airfoil about the cord.

18. A flying toy comprising:

a circular center airfoil having a diameter in the range of 5 inches to 12 inches, inclusive, an outer edge, a top surface, and a bottom surface, the top surface being planar, the bottom surface being planar and spaced apart from the top surface, an aperture in the symmetrical center of the circular center airfoil;

a circular outer rim having a diameter equal to the diameter of the circular center airfoil fastened to the circular center airfoil at the outer edge of the circular center airfoil, the cylindrical rim having a vertical height that extends beyond the top surface and bottom surface of the circular center airfoil;

a cord attached to the circular center airfoil by passing through the aperture in the circular center airfoil; and weighting means for increasing the weight of the flying toy at the intersection of said circular center airfoil and said cylindrical outer rim.

19. A flying toy comprising:

a circular center airfoil having a fixed diameter, an outer edge, a top surface, and a bottom surface, the top surface being planar, the bottom surface being planar and spaced apart from the top surface, the bottom surface having an indentation at its symmetrical center;

a cylindrical outer rim having a diameter equal to the diameter of the circular center airfoil fastened to the circular center airfoil at the outer edge of the circular center airfoil, the cylindrical rim having a vertical height that extends beyond the top surface and bottom surface of the circular center airfoil; and weighting means for increasing the weight of the toy at the intersection of said circular center airfoil and said cylindrical outer rim.

* * * * *

UNITED STATES PATENT AND TRADEMARK OFFICE

CERTIFICATE OF CORRECTION

PATENT NO. : 6,585,552 B2
DATED : July 1, 2003
INVENTOR(S) : Lawrence A. Huset

It is certified that error appears in the above-identified patent and that said Letters Patent is hereby corrected as shown below:

Column 1,
Line 8, delete "Dick" and insert -- Disc --.

Signed and Sealed this

Nineteenth Day of August, 2003

JAMES E. ROGAN
*Director of the United States Patent and Trademark Office*